US011174614B2

(12) United States Patent
Flint et al.

(10) Patent No.: US 11,174,614 B2
(45) Date of Patent: Nov. 16, 2021

(54) METAL FOUNDATION SYSTEM FOR CULVERTS, BURIED BRIDGES AND OTHER STRUCTURES

(71) Applicant: CONTECH ENGINEERED SOLUTIONS LLC, West Chester, OH (US)

(72) Inventors: Brian N. Flint, Mason, OH (US); Darrell J. Sanders, Mason, OH (US); Matthew L. Westrich, Cincinnati, OH (US)

(73) Assignee: CONTECH ENGINEERED SOLUTIONS LLC, West Chester, OH (US)

( * ) Notice: Subject to any disclaimer, the term of this patent is extended or adjusted under 35 U.S.C. 154(b) by 0 days.

(21) Appl. No.: 16/056,587

(22) Filed: Aug. 7, 2018

(65) Prior Publication Data

US 2019/0048553 A1 Feb. 14, 2019

Related U.S. Application Data

(60) Provisional application No. 62/545,009, filed on Aug. 14, 2017.

(51) Int. Cl.

| | |
|---|---|
| ***E02D 29/05*** | (2006.01) |
| ***E02D 27/32*** | (2006.01) |
| ***E01D 19/00*** | (2006.01) |
| ***E01D 1/00*** | (2006.01) |
| ***E01D 21/00*** | (2006.01) |
| ***E01D 18/00*** | (2006.01) |

(52) U.S. Cl.

CPC ..... *E02D 27/32* (2013.01); *E01D 1/00* (2013.01); *E01D 18/00* (2013.01); *E01D 19/00* (2013.01); *E01D 21/00* (2013.01); *E02D 29/05* (2013.01); *E02D 2250/0023* (2013.01); *E02D 2300/002* (2013.01); *E02D 2300/0032* (2013.01)

(58) Field of Classification Search

CPC ..... E01D 19/00; E02D 2300/0026; E02D 2300/0032; E02D 29/05

USPC ..... 14/78; 52/680, 682, 831, 843, 845; 249/5; 405/229; 404/135, 136

See application file for complete search history.

(56) References Cited

U.S. PATENT DOCUMENTS

| | | | | |
|---|---|---|---|---|
| 109,886 | A | 12/1870 | Freeman | |
| 567,653 | A | 9/1896 | Parker | |
| 1,074,268 | A | 9/1913 | Kelly | |
| 1,184,634 | A | 5/1916 | Duerrwachter | |
| 1,412,616 | A | 4/1922 | Kammerer | |
| 1,474,808 | A | 11/1923 | Zucco | |
| 1,615,178 | A * | 1/1927 | Moss | E01C 19/506 249/8 |
| 1,784,271 | A | 12/1930 | Collins | |
| 2,616,149 | A | 11/1952 | Waller | |
| 3,195,852 | A | 7/1965 | Lundell | |
| 3,286,972 | A | 11/1966 | Jackson | |
| 3,397,494 | A | 8/1968 | Waring | |
| 3,694,989 | A * | 10/1972 | Oliver | E04C 5/203 52/678 |
| 3,848,377 | A | 11/1974 | Mori | |

(Continued)

*Primary Examiner* — Gary S Hartmann

(74) *Attorney, Agent, or Firm* — Thompson Hine LLP

(57) ABSTRACT

A bridge system uses foundation structures that are formed of the combination of a metal-frame structure and cast-in-place concrete. The metal-frame structure of the foundation is capable of supporting bridge units before pouring of concrete.

21 Claims, 18 Drawing Sheets

(56) References Cited

U.S. PATENT DOCUMENTS 4,094,110 A 6/1978 Dickens
4,099,360 A 7/1978 Outram
4,141,666 A 2/1979 DeGraff
4,211,504 A 7/1980 Sivachenko
4,318,635 A 3/1982 Gurtner
4,558,969 A 12/1985 FitzSimons
4,563,107 A 1/1986 Peterson
4,587,684 A 5/1986 Miller
4,687,371 A 8/1987 Lockwood
4,693,634 A 9/1987 Chiaves
4,723,871 A 2/1988 Roscoe
4,797,030 A 1/1989 Lockwood
4,817,353 A 4/1989 Woods
4,854,775 A 8/1989 Lockwood
4,884,382 A * 12/1989 Horobin ..... E04B 2/8641 52/426
4,972,641 A 11/1990 Barrios
4,972,646 A 11/1990 Miller
4,987,707 A 1/1991 Kiselev
4,993,872 A 2/1991 Lockwood
5,005,331 A * 4/1991 Shaw ..... E01C 11/14 52/396.02
5,252,002 A 10/1993 Day
5,326,191 A 7/1994 Wilson
5,347,787 A * 9/1994 Gavin ..... E04C 5/203 248/74.3
5,505,033 A 4/1996 Matsuo
5,524,405 A 6/1996 Byrd
5,533,835 A 7/1996 Angelette
5,535,565 A * 7/1996 Majnaric ..... E04C 3/28 249/192
5,536,113 A 7/1996 McGregor
5,586,417 A 12/1996 Henderson
5,720,577 A 2/1998 Sanders
5,836,717 A 11/1998 Bernini
D406,902 S 3/1999 Lockwood
D426,321 S 6/2000 Lockwood
6,094,881 A 8/2000 Lockwood
6,161,342 A 12/2000 Barbier
6,205,717 B1 3/2001 Shall
6,243,994 B1 6/2001 Bernini
6,367,214 B1 4/2002 Monachino
6,408,581 B2 6/2002 Monachino
6,474,907 B2 11/2002 Semotiuk
6,568,651 B2 * 5/2003 Reid ..... E04G 13/00 249/191
6,640,505 B1 11/2003 Heierli
D484,610 S 12/2003 Lockwood
6,698,710 B1 * 3/2004 VanderWerf ..... E02D 27/02 249/159
6,719,492 B1 4/2004 Heierli
D490,533 S 5/2004 Lockwood
6,854,928 B2 2/2005 Lockwood
6,874,288 B1 * 4/2005 Washa ..... E04B 1/4157 52/371
6,922,950 B2 8/2005 Heierli
D511,215 S 11/2005 Vaia
D511,387 S 11/2005 Beach
6,962,465 B2 11/2005 Zax
D512,513 S 12/2005 Wasniak
6,988,337 B1 1/2006 Heierli
D514,706 S 2/2006 Beach
7,001,110 B2 2/2006 Lockwood
7,114,305 B2 10/2006 Heierli
7,131,624 B2 * 11/2006 Bogrett ..... A01G 9/28 249/4
7,217,064 B1 5/2007 Wilson
7,290,749 B1 * 11/2007 Jessop ..... E04G 13/00 249/34
7,305,798 B1 12/2007 Heierli
D566,852 S 4/2008 Gaster
D573,722 S 7/2008 Lockwood
7,556,451 B2 7/2009 Beach
7,568,860 B2 8/2009 Chiaves
7,770,250 B2 8/2010 Boresi
7,967,528 B2 * 6/2011 Mercer ..... E01C 11/14 404/60
D645,572 S 9/2011 Von Handorf
D658,976 S 5/2012 Morrow, Jr.
8,281,540 B2 * 10/2012 Strickland ..... E04C 3/065 52/634
8,327,599 B2 * 12/2012 Gavin ..... E04C 5/203 52/677
8,523,486 B2 9/2013 Aston
8,667,747 B2 * 3/2014 Repasky ..... E04D 11/007 52/126.5
8,789,337 B2 7/2014 Aston
8,887,465 B2 * 11/2014 Crosby ..... E04B 2/8635 52/405.4
8,925,282 B2 1/2015 Aston
9,317,191 B2 * 4/2016 Stanford ..... G06F 3/04842
9,695,558 B2 7/2017 Aston
D850,896 S * 6/2019 Shaw ..... D8/382
2005/0034394 A1 2/2005 Chiaves
2005/0087670 A1 * 4/2005 Kushlan ..... E01C 19/506 249/5
2005/0123354 A1 6/2005 Zax
2007/0131840 A1 * 6/2007 Jones ..... E04G 17/14 249/34
2007/0261341 A1 11/2007 Lockwood
2008/0006003 A1 1/2008 Skendzic
2010/0162654 A1 * 7/2010 Ferro De La Cruz .. E04C 5/203 52/678
2013/0008108 A1 1/2013 Aston
2013/0047530 A1 2/2013 Durham
2013/0202359 A1 8/2013 Aston
2013/0302093 A1 11/2013 Aston
2014/0090191 A1 4/2014 Aston
2014/0241805 A1 8/2014 Aston
2014/0248076 A1 * 9/2014 Shaw ..... E04B 1/483 403/194
2014/0363236 A1 12/2014 Vanbuskirk
2015/0322635 A1 11/2015 Aston
2017/0247843 A1 * 8/2017 Aston ..... E02D 27/32

* cited by examiner

METAL FOUNDATION SYSTEM FOR CULVERTS, BURIED BRIDGES AND OTHER STRUCTURES

TECHNICAL FIELD

The present application relates to the general art of structural, bridge and geotechnical engineering, and to the particular field of foundations for culverts, buried bridges other structures.

BACKGROUND

Buried bridge structures are frequently formed of precast or cast-in-place reinforced concrete and are used in the case of bridges to support a first pathway over a second pathway, which can be a waterway, a traffic route, or in the case of other structures, a storage space or the like. The term "buried bridge" will be understood from the teaching of the present disclosure, and in general as used herein, a buried bridge is a bridge formed of a bridge element or elements that rest on a foundation and has soil or the like resting thereon and thereabout to support and stabilize the structure and in the case of a bridge provide the surface of the first pathway.

In the past the bridge elements of overfilled bridge structures have been constructed to rest on prepared foundations at the bottom of both sides of the structure. Fill material, at the sides of the arch (backfill material) serves to diminish the outward displacements of the structure when the structure is loaded from above. The foundations previously used have typically been cast-in-place, requiring significant on-site preparation and manufacturing time and labor, and potential inconsistencies in quality control, making foundation preparation a very weather effected step of the construction process.

The foundation system of U.S. Pat. No. 8,789,337 solves many of the problems with such prior foundation systems by utilizing foundation structures that are formed by a combination of precast concrete and cast-in-place concrete. However, the precast concrete foundation units of such patent are heavy and can create labor-intensive manufacturing and shipping difficulties.

It would be desirable to improve upon the combination foundations described in U.S. Pat. No. 8,789,337 by providing a more readily transportable foundation unit.

SUMMARY

As used herein the term "cast-in-place" or "cast-in-place concrete" as used in reference to a structure or portion of a structure means that the concrete of the structure or portion of the structure was poured and cured at the installation/use location of the structure or portion of the structure.

As used herein the term "concrete" means traditional concrete as well as variations such as concrete formulas with plastics/polymers or resins incorporated therein or with fibers or other materials incorporated therein.

As used herein the terminology "bridge element" or "bridge structure" is intended to encompass structures that have spaced apart bottom sides or walls and one or more raised wall or walls spanning therebetween, it being understood that the geometry could vary (e.g., entirely curved, or some linear sections and some curved section or all linear sections) and the material could vary (e.g., metal, concrete etc.), which encompasses structures commonly referred to as either culverts and bridges in the art.

In a first aspect, a metal foundation unit for use in constructing a combination metal and cast-in-place concrete foundation structure is provided. The metal foundation unit includes a first elongated upright metal wall member and a second elongated upright metal wall member spaced apart from the first elongated upright wall member to define a channel therebetween, and multiple upright metal supports located within the channel. Each of the multiple upright metal supports extends laterally between the first elongated upright metal wall member and the second elongated upright metal wall member to (i) define multiple spaced apart cells along a length of the channel and (ii) rigidly connect the first elongated upright metal wall member to the second elongated upright metal wall member. Each of the multiple cells is open at the topA receiving slot (e.g., a keyway) is located atop each of the multiple upright metal supports. At least some of the multiple upright metal supports include at least one flow opening extending from cell to cell for permitting cast-in-place concrete to flow from one cell through the upright metal support to another cell during concrete pouring and multiple reinforcement openings through which elongated reinforcement can be passed from cell to cell prior to concrete pouring.

In another aspect, a bridge system includes first and second combination metal-frame and cast-in-place concrete foundation structures. The first combination metal-frame and cast-in-place concrete foundation structure includes: a first metal-frame foundation unit having an inner elongated upright metal plate wall and an outer elongated upright metal plate wall spaced apart from the inner elongated upright metal plate wall to define a channel therebetween, and multiple upright metal plate supports located within the channel and extending between and connecting the inner and outer elongated upright metal plate walls; and cast-in-place concrete within the channel of the first metal-frame foundation unit and tied to each of the inner and outer elongated upright metal plate walls at least by surface contact therewith and by substantial embedment of each of the upright metal plate supports. The second combination metal-frame and cast-in-place concrete foundation structure is spaced apart from the first combination metal-frame and cast-in-place concrete foundation structure and extends substantially parallel thereto. The second combination metal-frame and cast-in-place concrete foundation structure includes: a second metal-frame foundation unit having an inner elongated upright metal plate wall and an outer elongated upright metal plate wall spaced apart from the inner elongated upright metal plate wall to define a channel therebetween, and multiple upright metal plate supports located within the channel and extending between and connecting the inner and outer elongated upright metal plate walls; and cast-in-place concrete within the channel of the second metal-frame foundation unit and tied to each of the inner and outer elongated upright metal plate walls at least by surface contact therewith and by substantial embedment of each of the upright metal plate supports. A metal span bridge structure has spaced apart first and second sidewalls and an interconnecting top wall. A bottom portion of the first sidewall is supported by the first combination metal-frame and cast-in-place concrete foundation structure and at least partly embedded in the cast-in-place concrete of the first combination metal-frame and cast-in-place concrete foundation structure, and a bottom portion of the second sidewall supported by the second combination metal-frame and cast-in-place concrete foundation structure and at least partly embedded in the cast-in-place concrete of the second combination metal-frame and cast-in-place concrete foundation structure.

In a further aspect, a method of constructing a combination metal-frame and cast-in-place concrete foundation structure involves: receiving at a construction site a first metal-frame foundation unit having a first elongated upright wall member and a second elongated upright wall member spaced apart from the first elongated upright wall member to define a channel therebetween, and multiple upright supports located within the channel; placing the first metal-frame foundation unit at a desired use location of the construction site; delivering concrete into the channel of the first metal-frame foundation unit while the first metal-frame foundation unit remains at the desired use location; and allowing the concrete to cure-in-place such that each of the first and second elongated upright wall members are connected to the cured-in-place concrete by surface contact with the concrete and by substantial embedment of the upright supports in the concrete.

DETAILED DESCRIPTION

Figure 1:
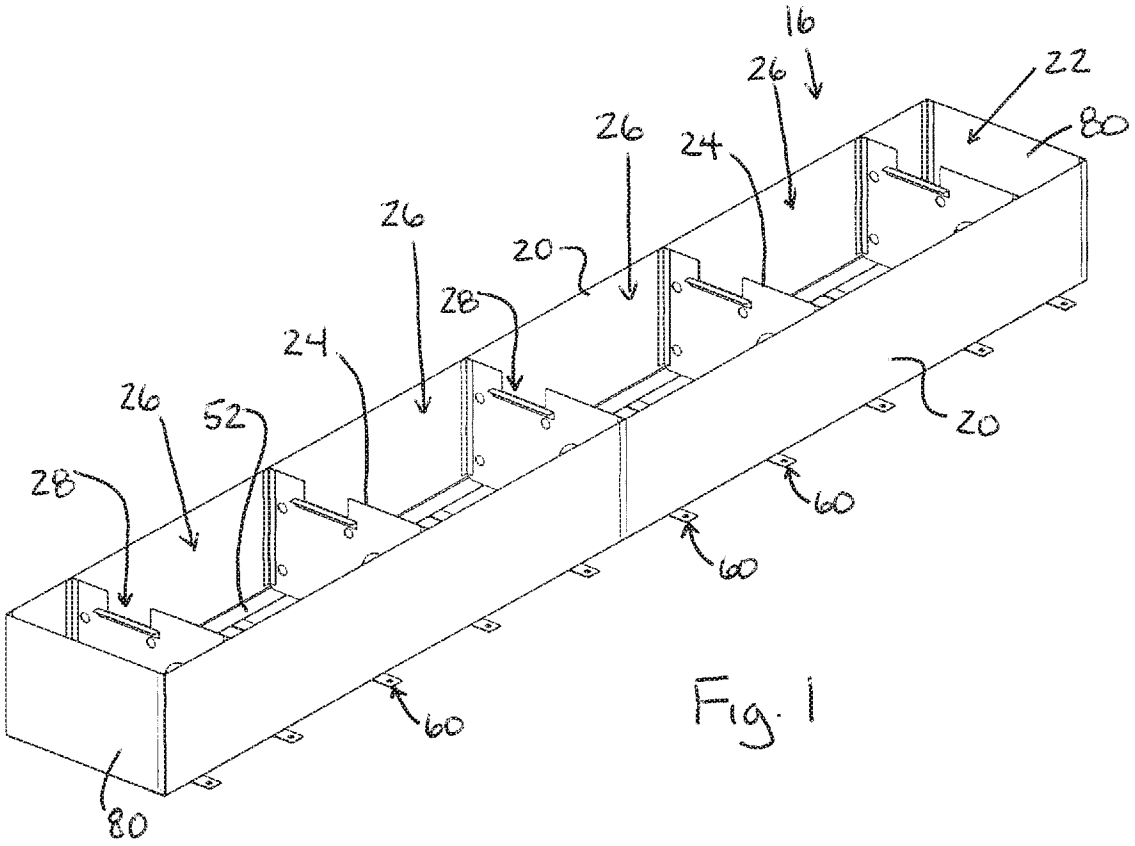
FIG. 1 is a perspective view of a metal-frame foundation unit.
Figure 2:
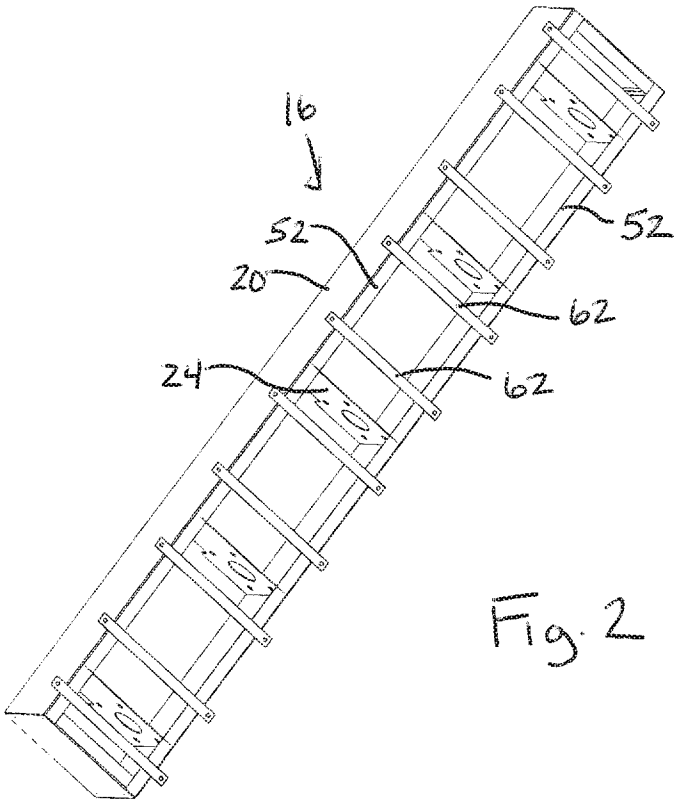
FIG. 2 is a bottom perspective of the unit of FIG. 1.
Figure 3:
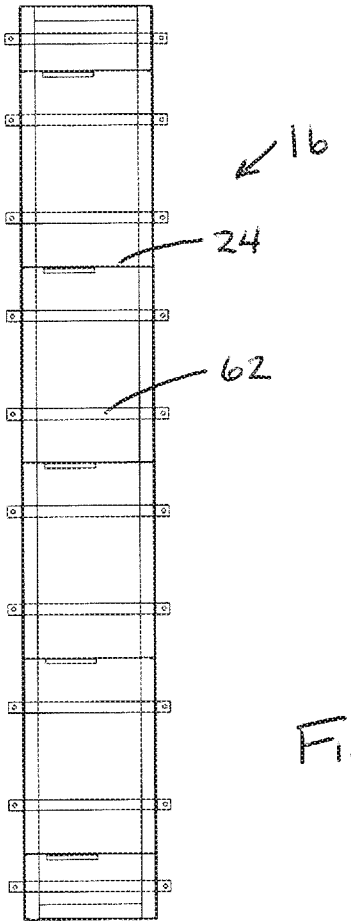
FIG. 3 is a top plan view of the unit of FIG. 1.
Figure 4:
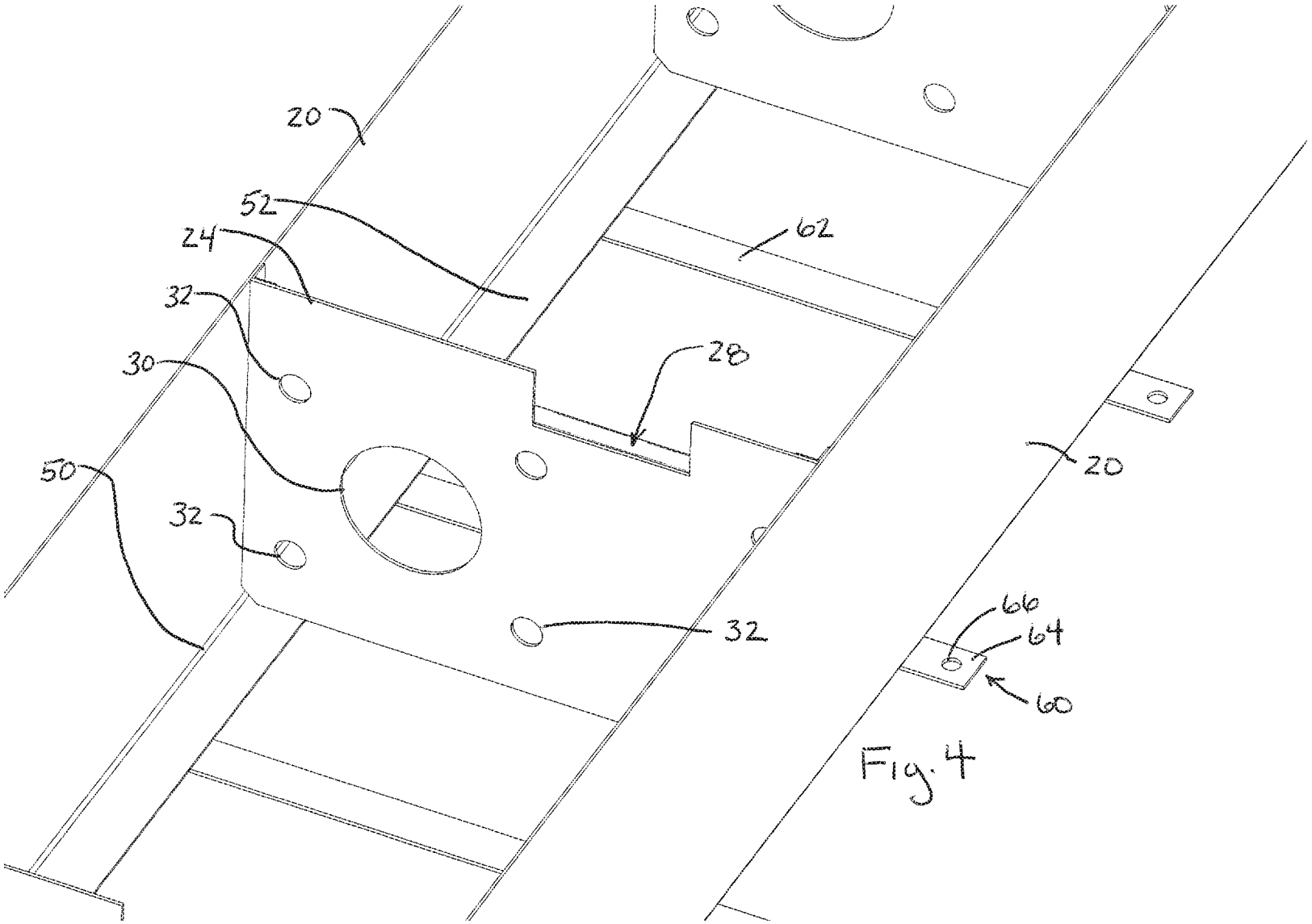
FIGS. 4-6 are an enlarged partial perspectives of the unit of FIG. 1.
Figure 5:
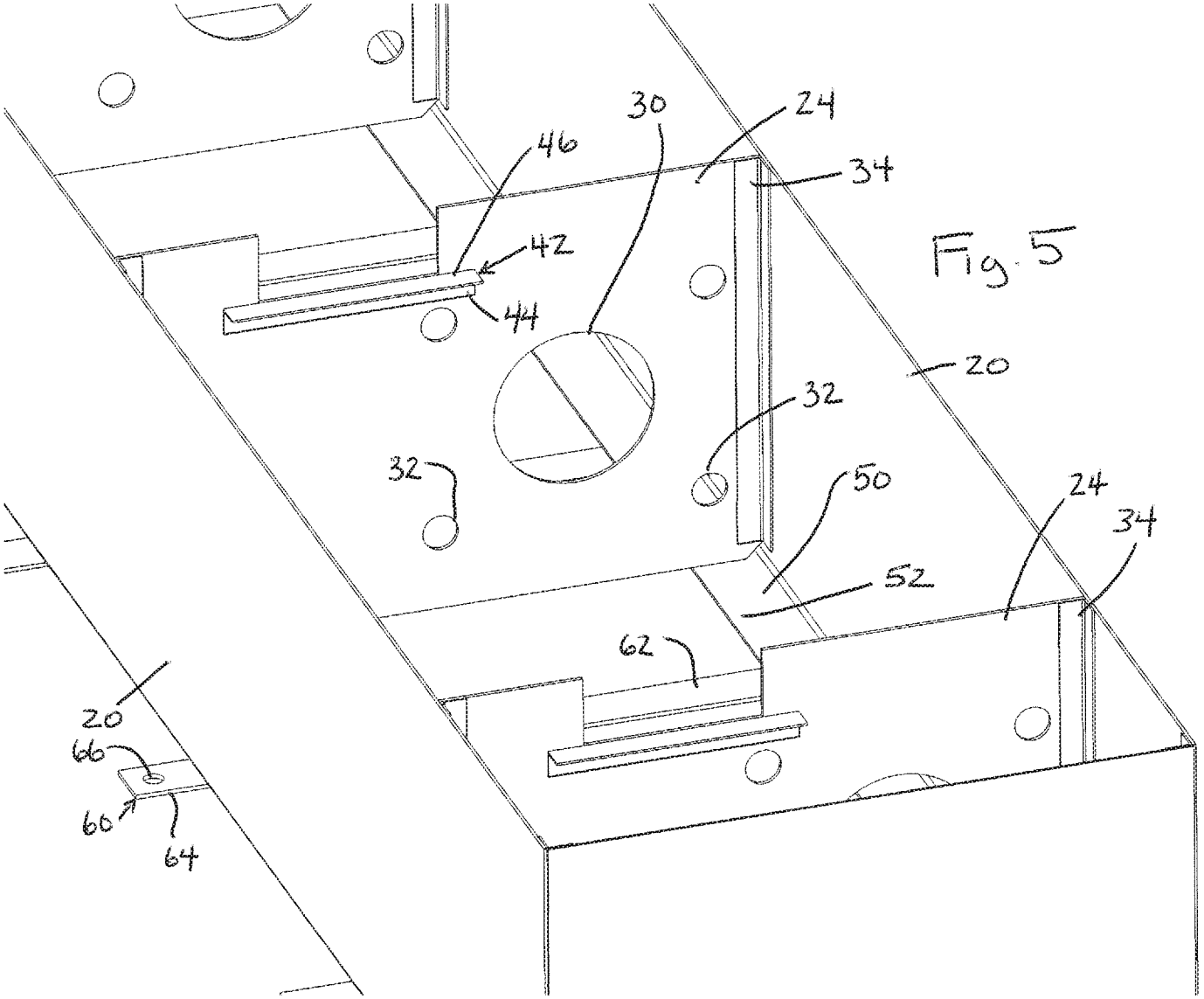
Figure 6:
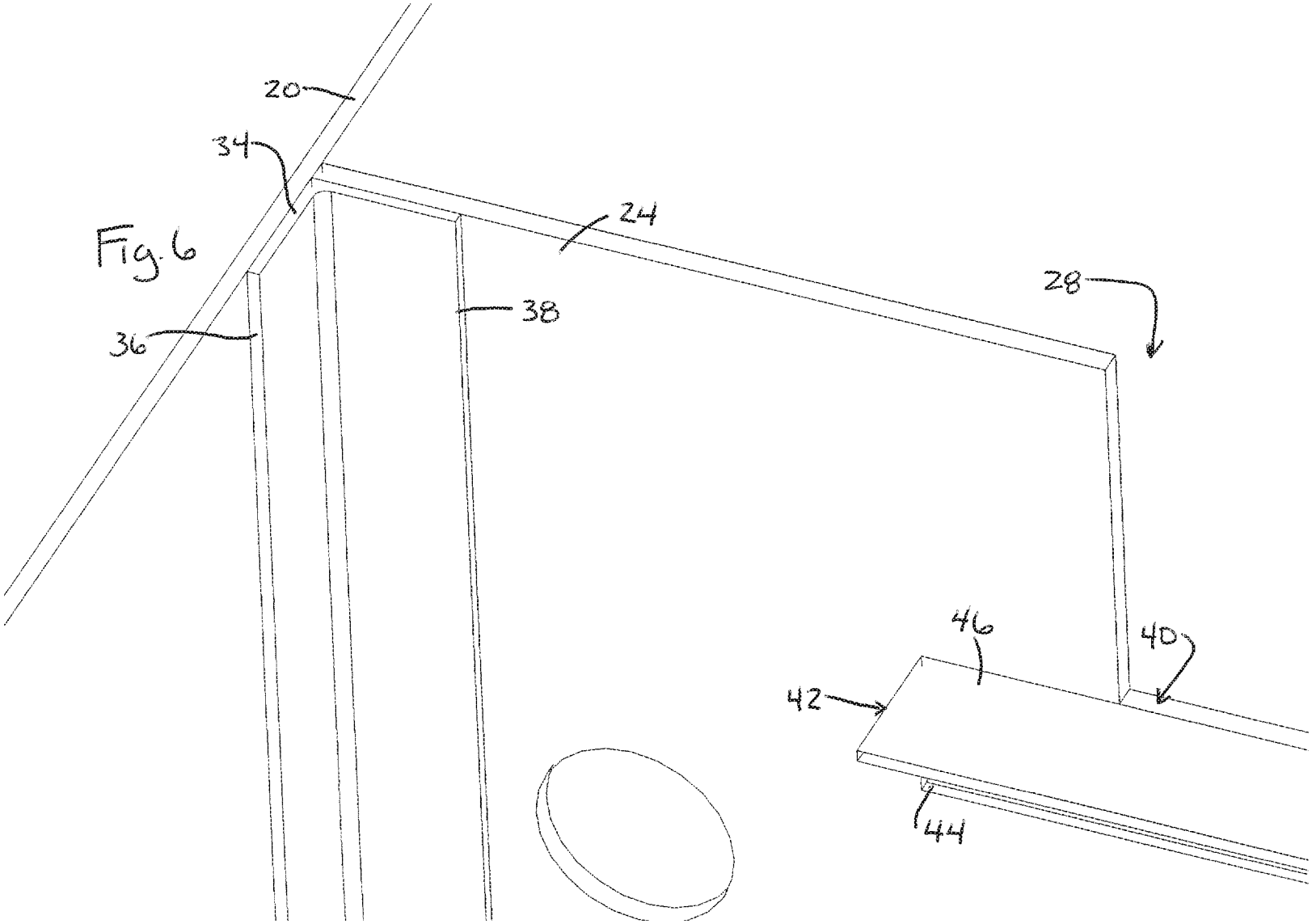
Figure 7:
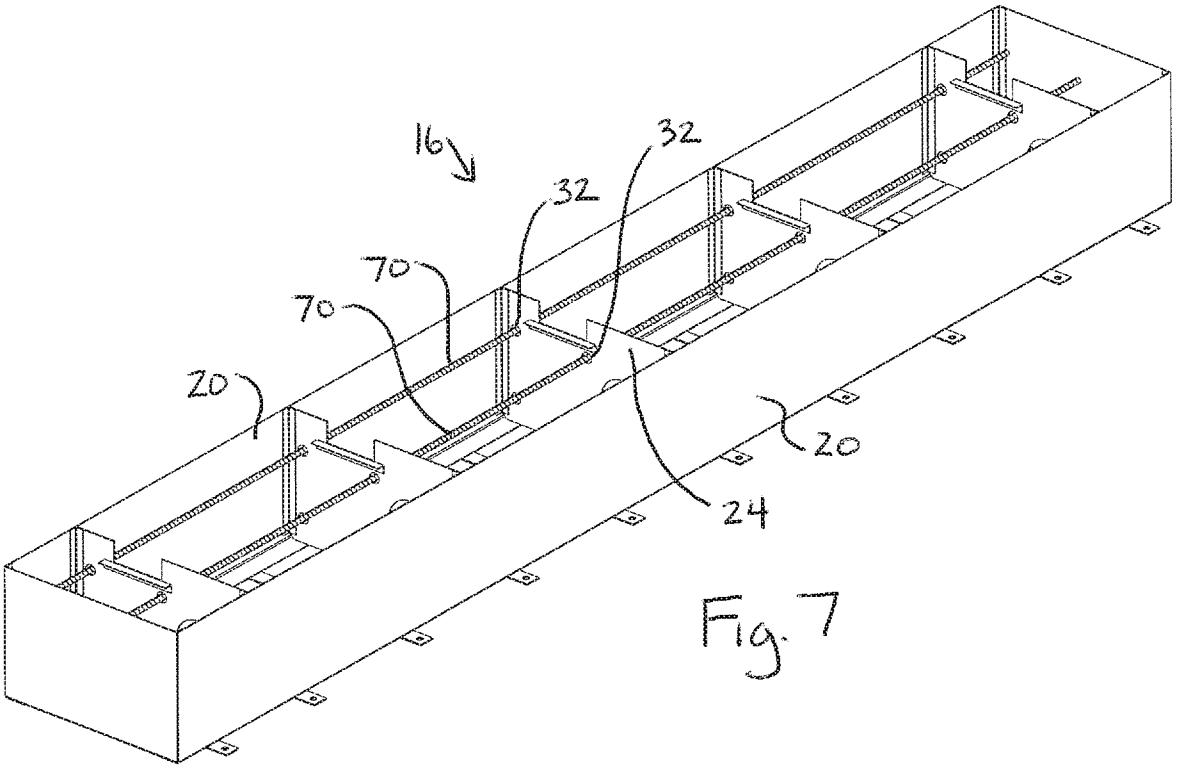
FIG. 7 is a perspective view of the unit of FIG. 1 including lengthwise reinforcement.
Figure 8:
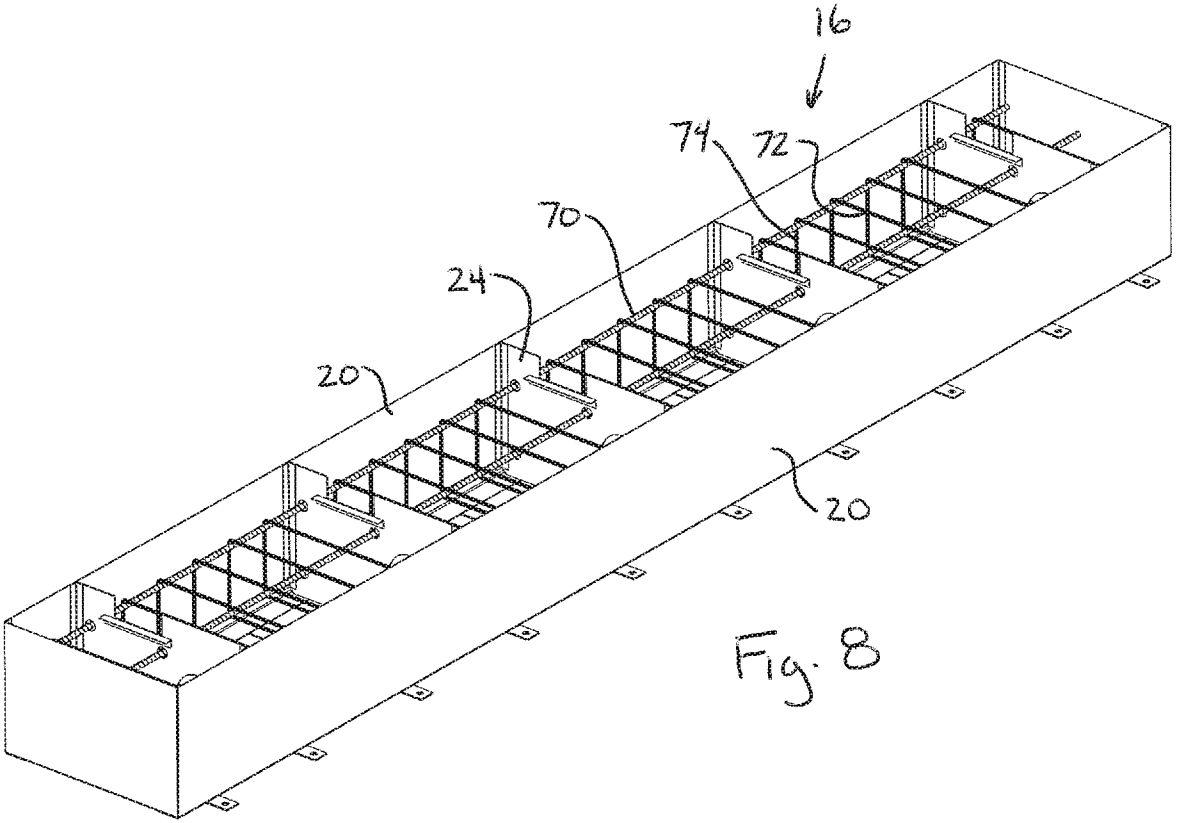
FIGS. 8-10 are perspective views of the unit with lengthwise, lateral and vertical reinforcement.
Figure 9:
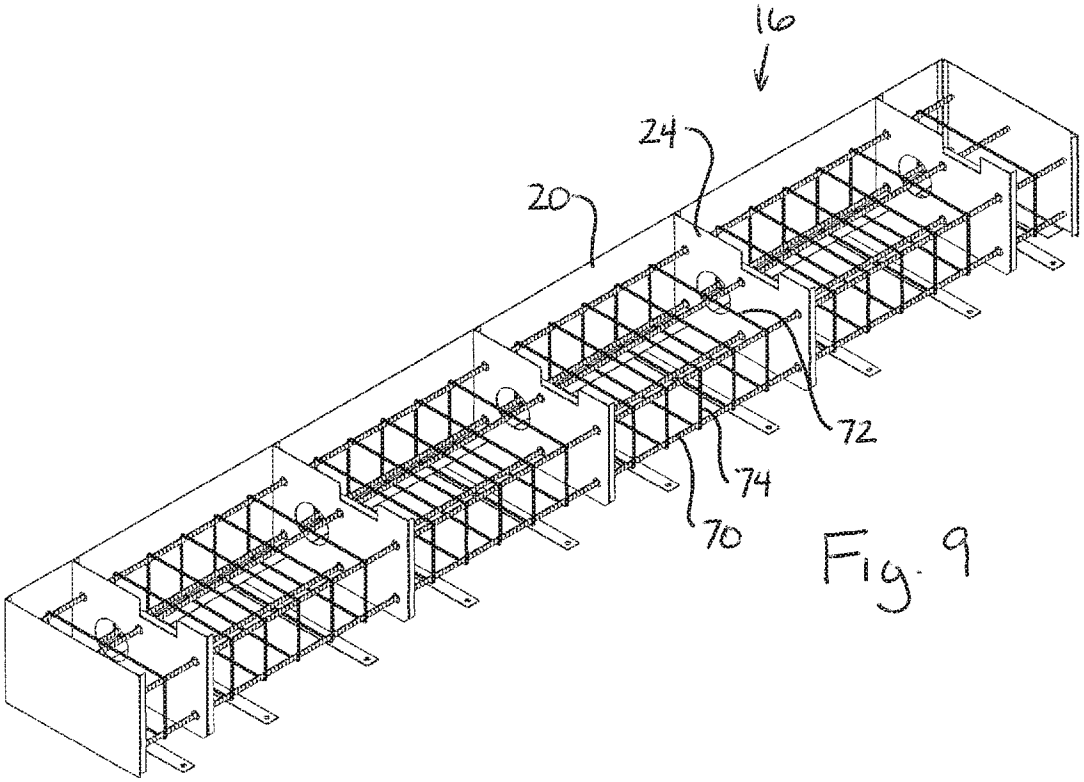
Figure 10:
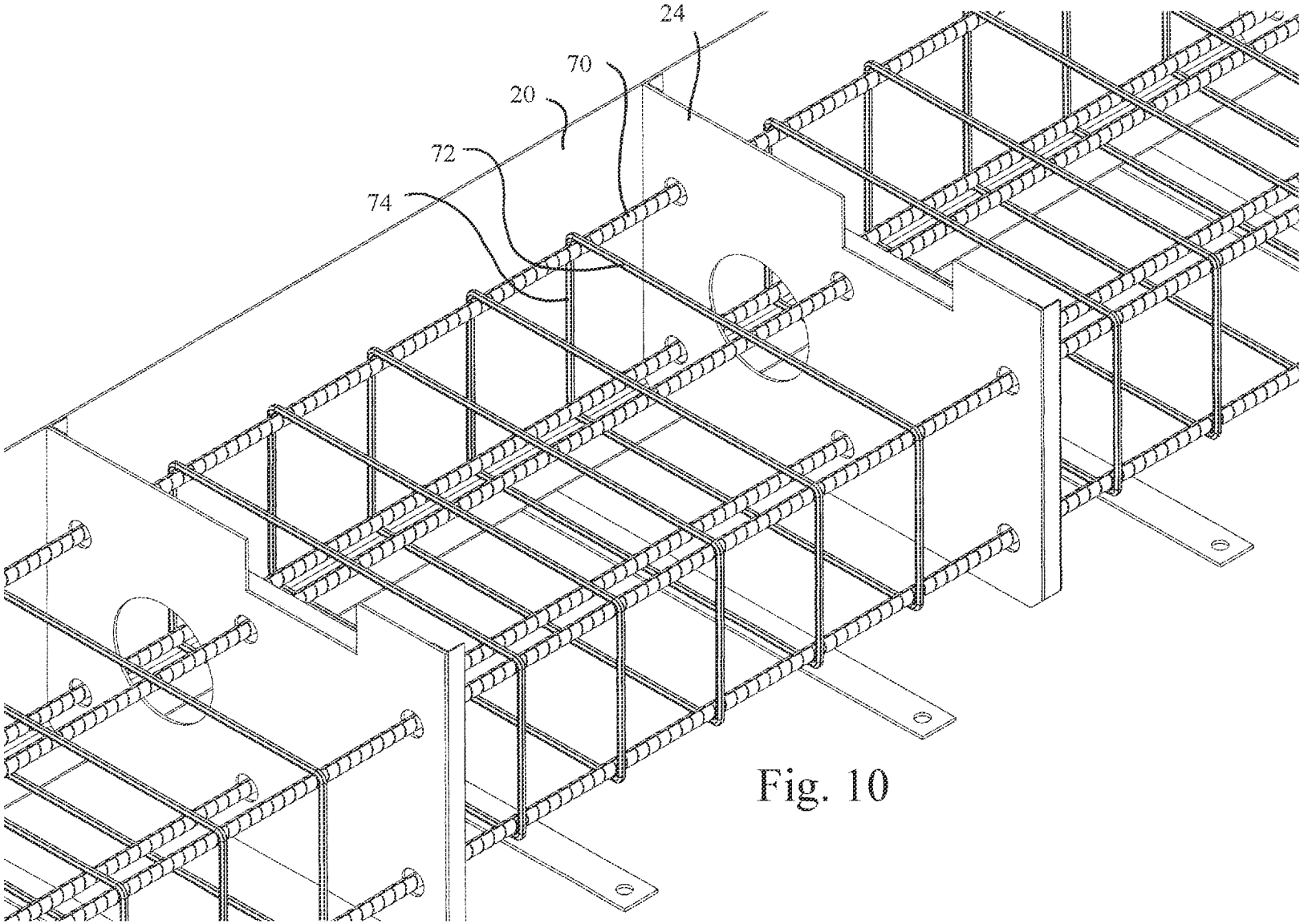

Referring to FIGS. 13-18, a bridge structure 10 is shown atop spaced apart foundation structures 12 that, when completed, are made up of both metal plate and cast-in-place concrete. In the illustrated embodiment bridge structure 10 is of arch-shaped corrugated metal plate construction with opposed sidewalls 11 and an interconnecting top wall 13. Each foundation structure 12 is formed by a number of metal foundation units 16 laid end to end (e.g., ends abutting each other).

As best seen with reference to FIGS. 1-6 each metal foundation unit 16 is a metal-frame configuration and includes spaced apart upright metal plate walls 20 extending upwardly and defining an interior channel 22, and a series of upright spaced apart metal plate supports 24 extending laterally between the metal plate walls 20 to (i) define multiple spaced apart cells 26 along a length of the channel 22 and (ii) rigidly connect the metal plate walls together. The thickness of the metal plate utilized may vary according to required load capacity of the foundation unit, but a typical thickness range of about 0.1046 inches to about 0.375 inches is expected. Material of the plate may also vary, such as steel (black or hot dipped galvanized) or aluminum.

Each of the multiple cells 26 is open at both the top and the bottom, and a receiving slot 28 is located atop each of the multiple upright metal plate supports 24. The upright metal plate supports 24 include at least one flow opening 30 extending from cell to cell for permitting cast-in-place concrete to flow from one cell through the upright metal support to another cell during concrete pouring and multiple reinforcement openings 32 through which elongated reinforcement can be passed from cell to cell prior to concrete pouring, as will be described in further detail below.

Generally, the upright metal supports 24 may be connected to the upright walls 20 in any suitable manner (e.g., welding, rivets, nuts and bolts etc.) that provides sufficient rigidity and strength to the metal-frame foundation unit. In the illustrated embodiment, each upright metal support 24 has ends fixed (e.g., by welding) to respective brackets 34 mounted (e.g., welded) at the interior sides of the upright metal walls 20. Here, each bracket is an angle member with one flange 36 seated against the interior side of the wall 20 and one flange 38 seated against one side of the support 24.

In the illustrated embodiment, the receiving slots 28 are formed by a cut-out at the top of the metal plate. A lower support surface 40 of each receiving slot 28 is defined at least in part by a bracket 42 fixed (e.g., bolted or welded) to a side of the metal plate support 24. Each bracket 42 includes an upright mounting flange 44 adjacent metal plate and a support flange 46 extending laterally from the mounting flange to at least in part define the lower support surface 40.

Each of the metal plate walls 20 includes a bottom bend 50 forming a lateral ground surface seating flange 52. The seating flange 52 helps support the metal-frame foundation unit against sinking into the ground during installation. The bend 50 also provides additional overall rigidity to the overall metal-frame foundation unit structure. Here, each lateral ground surface seating flange 52 is located within the channel 22. In alternative embodiments the bends could be outward to place the seating flanges 52 exterior of the channel. In addition, the flanges could be sized larger, such as to abut or overlap and effectively close the bottom of the channel. A separate bottom panel could also be connected between the bottoms of the metal plate walls to close the bottom of the channel.

A plurality of stabilizing members 60 are located at the bottom of the metal foundation unit for inhibiting sliding movement of the metal foundation unit on a ground surface (e.g., during backfill and/or concrete pouring). Generally, the stabilizing members may take any suitable configuration, such as a stake opening in a portion of metal plate that is either internal of the channel or external of the channel and/or a downwardly projecting metal member at the bottom of the metal foundation unit and that is either internal of the channel or external of the channel. In the illustrated embodiment, the stabilizing members 60 are formed by a plurality of metal straps 62 extending laterally across the bottom of the channel 22 and below the metal plate walls 20. The straps 62 may be welded or otherwise fixed to the wall seating flanges 52. Each metal strap includes end portions 64 exterior of the channel 22 and having a respective stake opening 66 through which a stake or spike can be driven into the ground when the metal-frame foundation unit is properly positioned on-site for install.

As seen in FIG. 7-10, in use, reinforcement bar/rods 70 are passed through the aligned openings 32 in the metal plate supports 24 so that the reinforcement 70 runs from one cell to the next along the length of the metal-frame foundation unit 16. Lateral reinforcement 72 and vertical reinforcement 74, tied to reinforcement 70, is formed here by multiple instances of wrapped/looped reinforcement wire/bar in each cell may complete the rebar cage for the foundation unit. The rebar cage may be incorporated into the metal-frame foundation unit 16 at the site of foundation unit manufacture or at the installation site, or a combination of both. Regardless, when the foundation unit is positioned at the installation location and concrete is poured into the channel, the rebar cage becomes embedded in the concrete and some concrete passes through the flow openings 30 in the metal plate supports 24.

In some cases the foundation structure needed at a given installation site may be short enough to permit the use of a single metal-frame foundation unit at each side of the bridge installation, in which case the foundation unit will typically include closed metal plate end walls 80 at the ends of the unit to retain concrete in the channel during the on-site pour.

Figure 11:
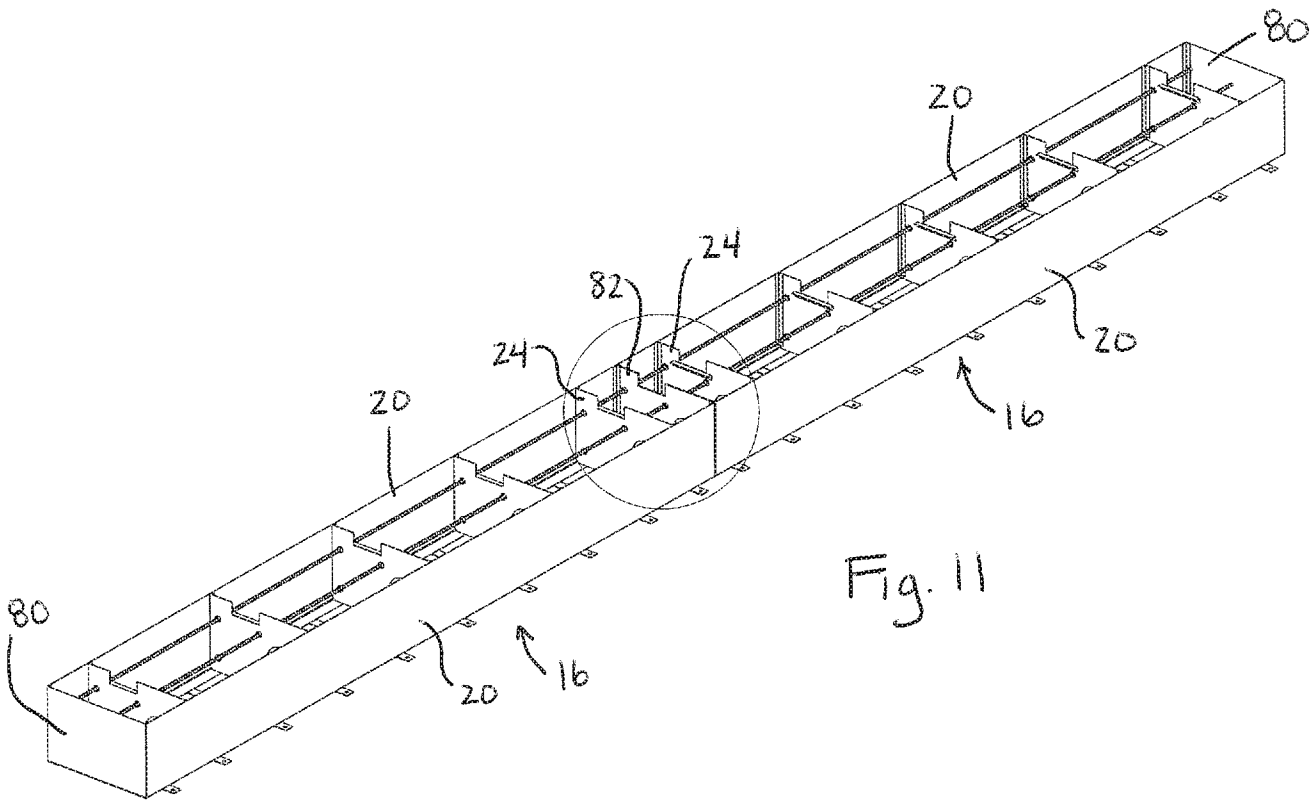
FIG. 11 is a perspective view of multiple metal-frame foundation units connected end-to-end.
Figure 12:
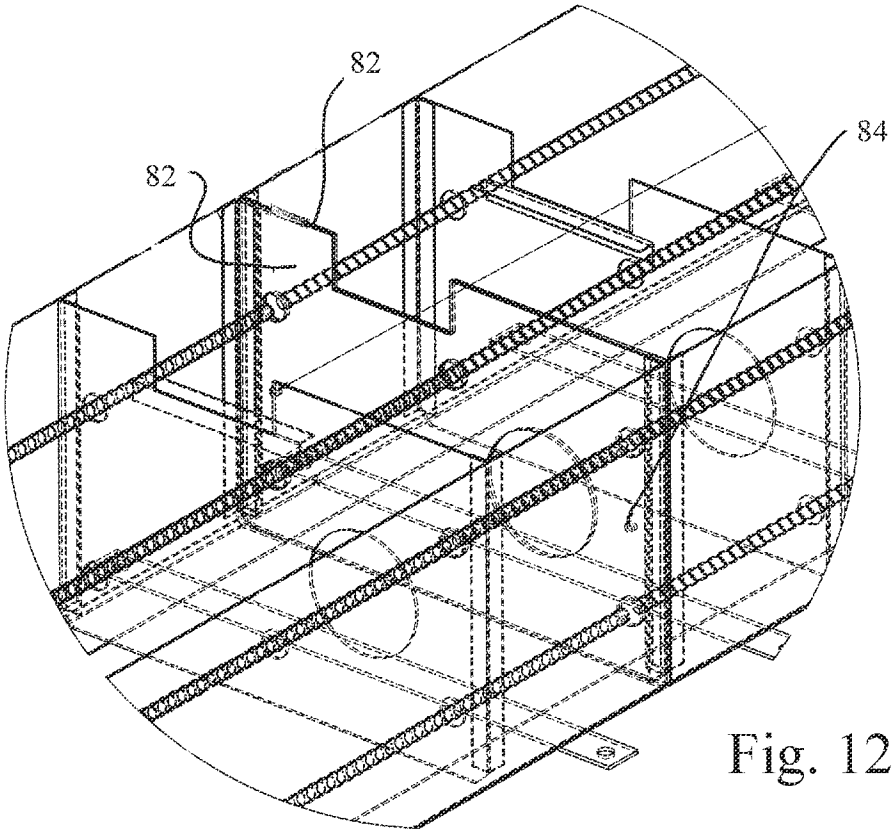
FIG. 12 is an enlarged partial perspective of the connection between the ends of the units of FIG. 11.
Figure 15:
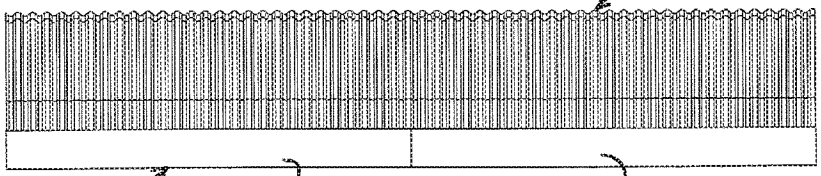
FIGS. 13-17 show a bridge system including a bridge structure atop a set of metal-frame foundation units.
Figure 14:
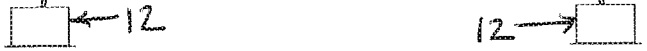
Figure 13:
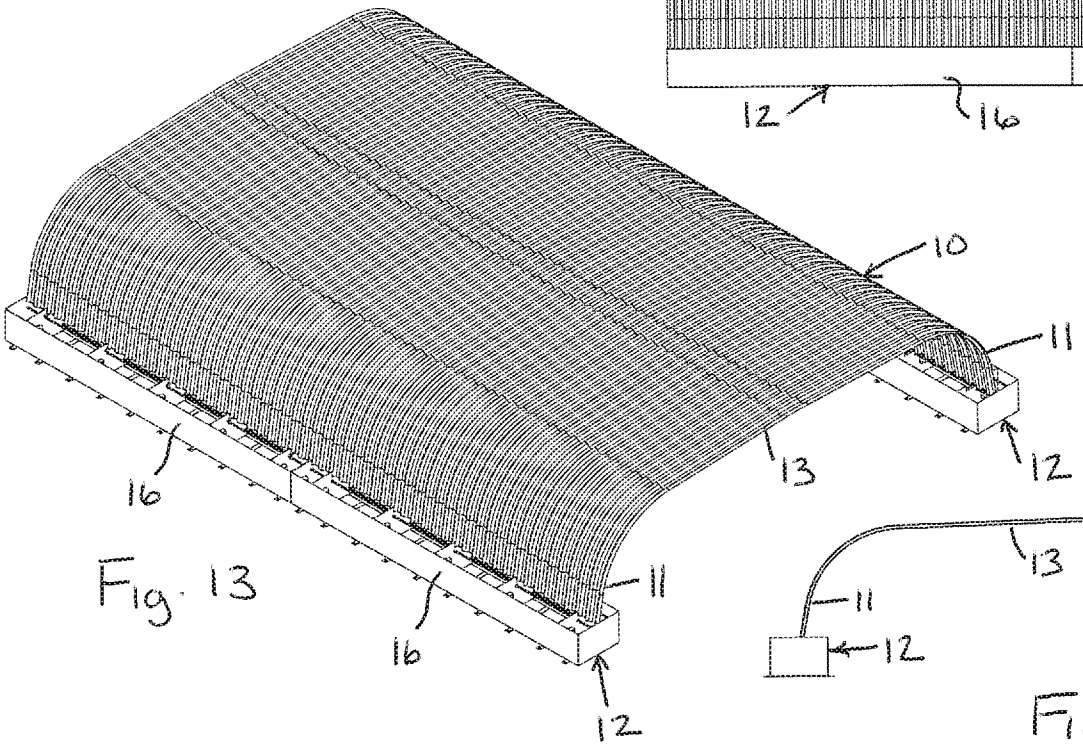

In other cases the foundation structure needed at a given installation site may require two of more metal-frame foundation units 16 to be connected end to end as shown in FIGS. 11 and 12. Where the end of a given metal-frame foundation unit will be connected with the end of another metal-frame foundation unit, the closed end walls 80 may be eliminated in favor of end walls 82 that mimic the upright supports 24 in terms of inclusion of a concrete flow opening, reinforcement openings and an upper receiving slot. The end walls 82 also include aligned sets of connection openings 84 that are used for bolting the two foundation units together in a rigid manner. This connection would typically occur at the installation site before concrete pouring, but in some cases could occur at the manufacturing site. The lengthwise reinforcement 70 of the two foundation units may also be interconnected or tied together at the installation site as needed.

The metal-frame foundation units are shipped to and received at a construction site. In use, a final use/installation site is prepared to receive the metal-frame foundation units by excavating to the desired elevation in a smaller area than traditional methods and preparing a level subsurface which may include additional backfill materials on which to install the units.

Figure 16:
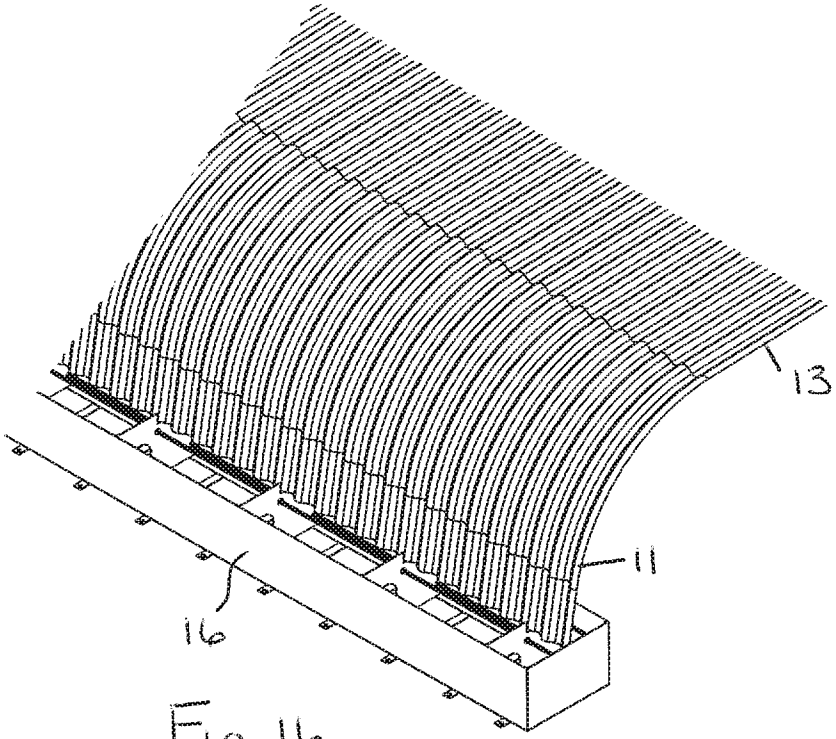
Figure 17:
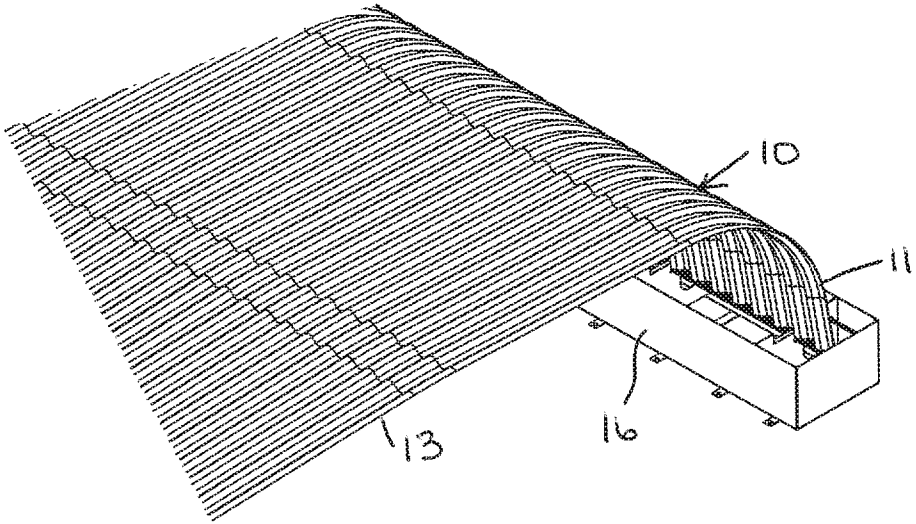
Figure 18:
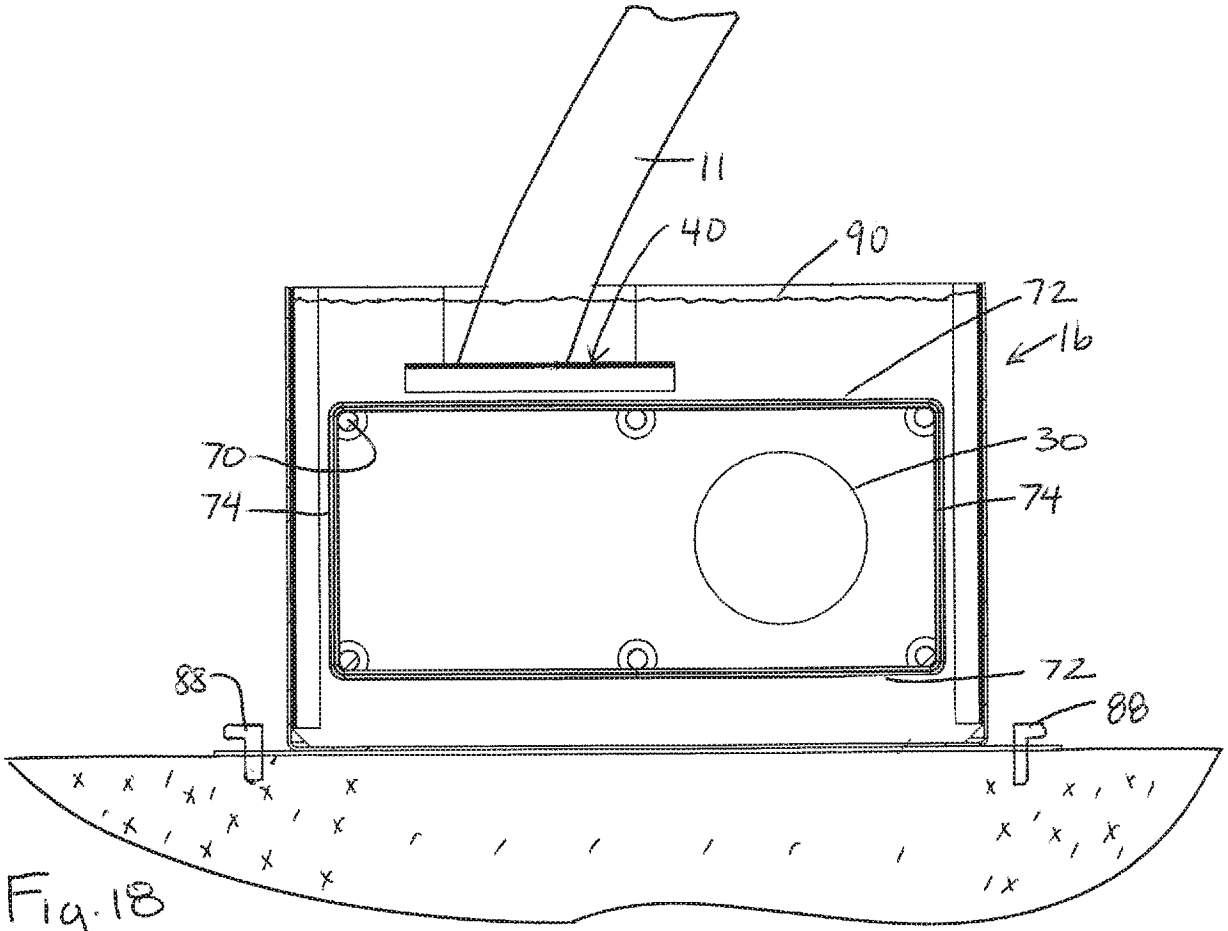
FIG. 18 is a schematic end view showing bridge structure embedment in concrete poured into the channel of the metal-frame foundation unit.

Once the site is prepared to receive the metal-frame foundation units 16, the units are placed to form two spaced apart foundation structures 12. Once the metal-frame foundation units 16 are set in desired positions (with or without the use of stakes or spikes 88), the reinforcement can be manually placed and/or adjusted if needed (i.e., in cases where the reinforcement was not incorporated prior to shipping to the job site) and the bridge structure 10 placed (as a single unit or by interconnecting multiple pieces) atop the metal-plate supports 24. In this regard, as shown in FIGS. 16-18, the bottoms of the bridge unit sidewalls 11 may rest directly atop the support surfaces 40 and/or shims may be provided as needed for proper alignment and positioning. Once the bridge structure 10 is set, concrete is poured into the U-shaped channel to complete the foundation structure, thereby forming a composite or combination foundation formed of both metal-frame foundation unit(s) and cast-in-place concrete. The U-shaped channel may be substantially filled with poured concrete 90 to create a combination metal-frame and cast-in-place foundation structure. The cast-in-place concrete 90 may typically be poured to the top of the channel or just below the top of the channel, in either case sufficiently high to embed and capture the bottom ends of the bridge structure so as to integrate the bridge structure with the foundation. After the cast-in-place concrete has been poured and has begun curing, the typical backfill and overfill operations including backfilling, compaction and preparation of final surfaces above the structure can take place.

While embedment of the bottom ends of the bridge structure is contemplated, in some instances the concrete may be poured in the U-shaped foundation prior to the bridge being set in place.

Figure 20:
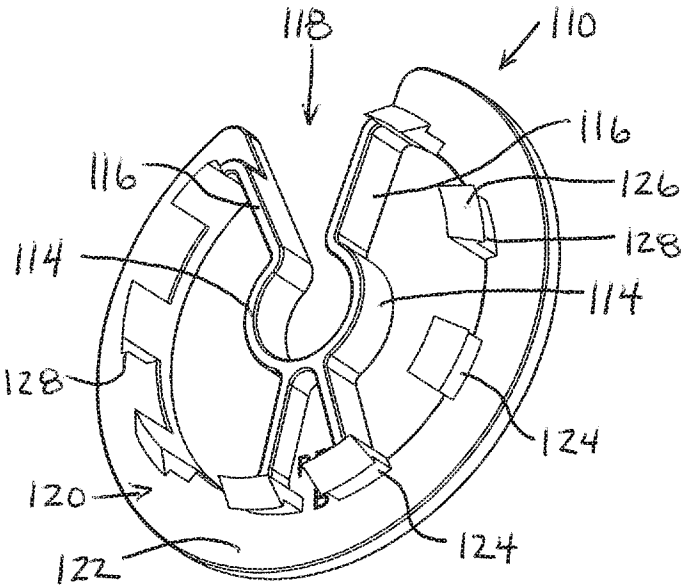
FIGS. 19 and 20 show perspective views of a spacing gusset.
Figure 19:
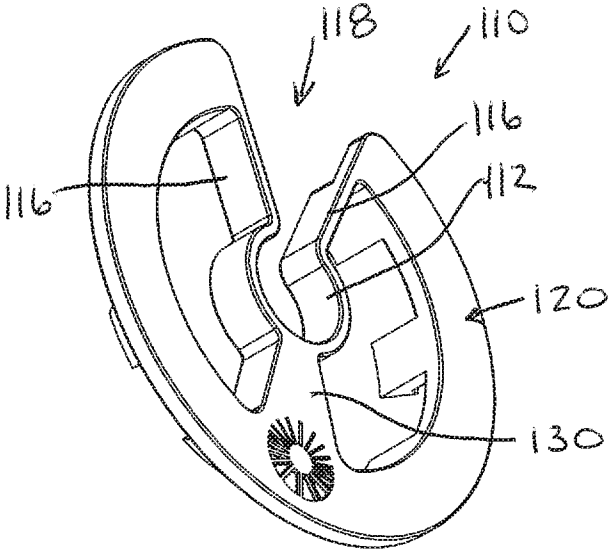
Figure 21:
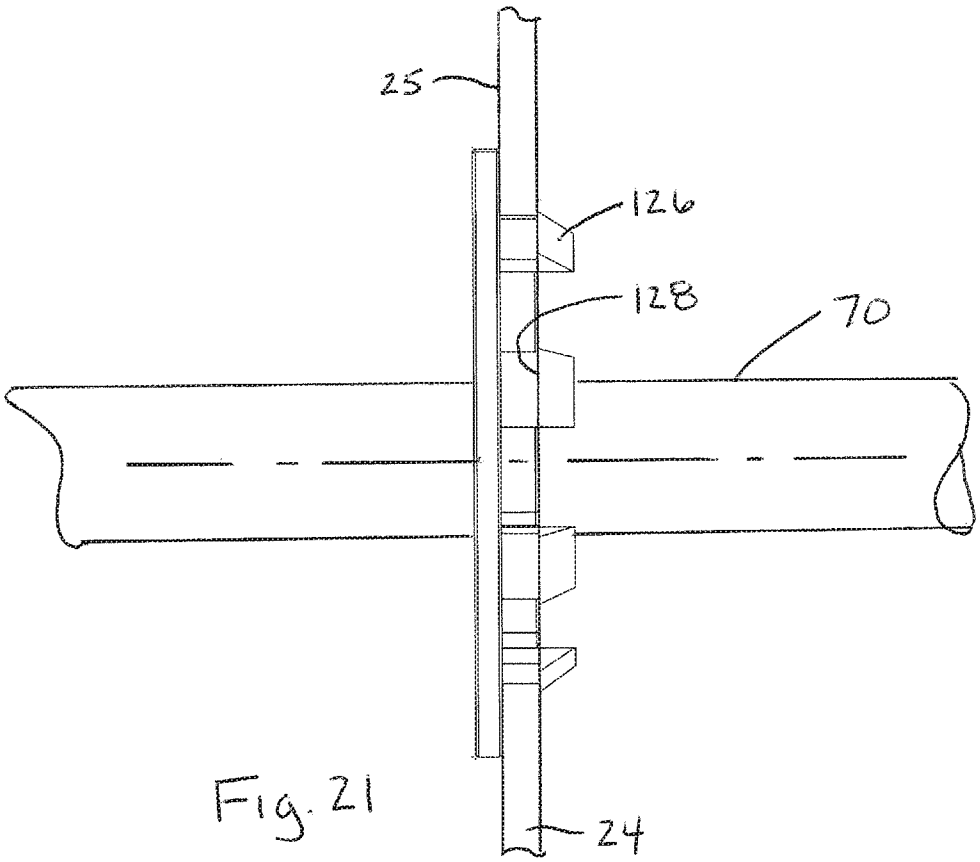
FIG. 21 shows a side elevation of the spacing gusset supporting longitudinal reinforcement within an opening of a metal plate support.

With respect to lengthwise reinforcement 70, support for such reinforcement within the openings 32 of the metal plate supports 24 may be provided. In this regard, reference is made to FIGS. 19-21, showing a spacing gusset 110 that snap-fits into the opening 32. The spacing gusset, which may be of a plastic material, includes a substantially central support collar 112 formed by opposed arcuate segments 114, where the support collar 112 is open at the top where a pair of lateral lead-in guides 116 join the arcuate segments to form an entry throat 118 leading to the support collar. The lead-in guides are angled toward each other so that the throat is angled to facilitate installation of the gusset onto the reinforcement by aligning the throat 118 with the reinforcement and then moving the gusset toward the reinforcement along the throat until the reinforcement snaps into the support collar space (e.g., where the narrowest portion of the throat is just slightly smaller than the diameter of the reinforcement). After the reinforcement 70 is inserted into the foundation unit 16 (by passing through the aligned openings 32), a spacing gusset can be engaged with the reinforcement at the location of each opening 32, and the gusset then pushed into the opening 32 to support the reinforcement in the opening, preventing the reinforcement 70 from being in direct contact with the metal plate support 24.

The spacing gusset 110 includes an outer flange 120 with one face 122 that is substantially planar so as to seat flushly against one face 25 of the metal support plate 24 when the gusset is installed. A plurality of circumferentially spaced latching fingers 124 extend from the outer flange 120, and each finger includes a ramped portion 126 that leads to an outwardly facing lip 128 that faces the seating face 122 of the flange 120. The fingers are sized such that the ramped portions 126 engage the edge of the opening 32 during insertion, causing the fingers to flex slightly until the spacing gusset is fully seated in the opening and the fingers spring back out so that the lips 128 extend out beyond the opening edge and retain the spacing gusset in the opening per the depiction in FIG. 21. The gusset also includes a support stanchion 130 extending upward from the lower portion of the flange to the support collar 112.

The combination metal-frame and cast-in-place concrete foundation structures described herein can be utilized to support bridge structures other than metal plate bridge structures. Moreover, other types of structures could be supported as well. On-site time and expense associated with foundation placement is reduced (e.g., the need for form placement and much of the reinforcement placement is eliminated).

It is to be clearly understood that the above description is intended by way of illustration and example only and is not intended to be taken by way of limitation, and that changes and modifications are possible. For example, the metal foundation units could also be used to establish the foundations for wingwalls of a bridge system. Accordingly, other embodiments are contemplated and modifications and changes could be made without departing from the scope of this application.

What is claimed is:

1. A metal foundation unit for use in constructing a combination metal and cast-in-place concrete foundation structure, the metal foundation unit comprising:

a first elongated upright metal wall member and a second elongated upright metal wall member spaced apart from the first elongated upright wall member to define a channel therebetween, and multiple upright metal supports located within the channel, each of the multiple upright metal supports extends laterally between the first elongated upright metal wall member and the second elongated upright metal wall member to (i) define multiple spaced apart cells along a length of the channel and (ii) rigidly connect the first elongated upright metal wall member to the second elongated upright metal wall member, each of the multiple cells is open at the top, a receiving slot is located atop each of the multiple upright metal supports, at least some of the multiple upright metal supports include at least one flow opening extending from cell to cell for permitting cast-in-place concrete to flow from one cell through the upright metal support to another cell during concrete pouring and multiple reinforcement openings through which elongated reinforcement can be passed from cell to cell prior to concrete pouring;

wherein at least one reinforcement opening includes a spacing gusset inserted therein and which supports longitudinal reinforcement within the at least one reinforcement opening in a position that prevents contact between the longitudinal reinforcement and an inner edge of the at least one reinforcement opening.

2. A combination metal and cast-in-place concrete foundation structure incorporating the metal foundation unit of claim 1, located at a bridge installation site, comprising:

cast-in-place concrete within the channel of the metal foundation unit along with longitudinal and lateral steel reinforcement embedded in the cast-in-place concrete, wherein the cast-in-place concrete substantially closes each cell from top to bottom, and cast-in-place concrete is located within flow openings of the upright metal supports.

3. A bridge system including the combination metal and cast-in-place concrete foundation structure of claim 2, wherein a bottom of one sidewall of a bridge structure lies within the receiving slots and is embedded within the cast-in-place concrete.

4. The bridge system of claim 3 wherein the bridge structure is a metal bridge of arch-shaped corrugated metal plate construction.

5. The metal foundation unit of claim 1 wherein a lower support surface of each receiving slot is defined at least in part by a bracket welded to a side of the metal plate.

6. The metal foundation unit of claim 5 wherein each bracket includes an upright mounting flange welded to the metal plate and a support flange extending laterally from the mounting flange to at least in part define the lower support surface.

7. The metal foundation unit of claim 1 wherein the first elongated upright metal wall member is of metal plate construction and the second elongated upright metal wall member is of metal plate construction.

8. The metal foundation unit of claim 7 wherein each cell is open at the bottom, the metal plate of the first elongated upright metal wall member includes a bottom bend forming a lateral ground surface seating flange and the metal plate of the second elongated upright metal wall member includes a bottom bend forming a lateral ground surface seating flange.

9. The metal foundation unit of claim 8, wherein each lateral ground surface seating flange is located within the channel.

10. The metal foundation unit of claim 1 further comprising a plurality of stabilizing members at the bottom of the metal foundation unit for inhibiting sliding movement of the metal foundation unit on a ground surface.

11. The metal foundation unit of claim 10 wherein the stabilizing members comprise a plurality of metal straps extending laterally across the bottom of the channel, each metal strap having at least one opening therein for receiving a stake.

12. The metal foundation unit of claim 11 wherein each metal strap includes a first end portion exterior of the channel and a second end portion exterior of the channel, the first end portion including at least one stake opening and the second end portion including at least one stake opening.

13. The metal foundation unit of claim 10 wherein each stabilizing member comprises (i) a stake opening in a portion of metal plate that is either internal of the channel or external of the channel and/or (ii) a downwardly projecting metal member at the bottom of the metal foundation unit and that is either internal of the channel or external of the channel.

14. The metal foundation unit of claim 1 wherein each upright metal support is of metal plate construction, a first end of the metal plate is fixed to a first bracket mounted on an interior side of the first elongated upright metal wall member and a second end of the metal plate is fixed to a second bracket mounted on an interior side of the second elongated upright metal wall member.

15. The metal foundation unit of claim 1 wherein the receiving slot of each of the multiple metal supports is located entirely within the channel.

16. A bridge system, comprising:

a first combination metal-frame and cast-in-place concrete foundation structure defined by the combination metal-frame and cast-in-place concrete foundation structure of claim 2;

a second combination metal-frame and cast-in-place concrete foundation structure, including a second metal foundation unit defining a second channel and cast-in-place concrete within the second channel, wherein the second combination metal-frame and cast-in-place concrete foundation structure is spaced from the first combination metal-frame and cast-in-place concrete foundation structure;

a metal span bridge structure having spaced apart first and second sidewalls and an interconnecting top wall, a bottom portion of the first sidewall supported by the first combination metal-frame and cast-in-place concrete foundation structure and at least partly embedded in the cast-in-place concrete of the first combination metal-frame and cast-in-place concrete foundation structure, and the bottom portion of the second sidewall supported by the second combination metal-frame and cast-in-place concrete foundation structure and at least partly embedded in the cast-in-place concrete of the second combination metal-frame and cast-in-place concrete foundation structure.

17. A foundation unit for use in constructing a combination metal and cast-in-place concrete foundation structure, the foundation unit comprising:

a first elongated upright metal wall member and a second elongated upright metal wall member spaced apart from the first elongated upright wall member to define a channel therebetween, and multiple upright metal supports located within the channel, wherein the multiple upright metal supports extend laterally between the first elongated upright metal wall member and the second elongated upright metal wall member to (i) define multiple cells along a length of the channel and (ii) rigidly connect the first elongated upright metal wall member to the second elongated upright metal wall member, wherein each of the cells is open at the top, wherein at least one upright metal support includes at least one flow opening extending therethrough for permitting cast-in-place concrete to flow from a first one of the cells through the upright metal support to a second one of the cells during concrete pouring, wherein at least one of the upright metal supports includes at least one reinforcement opening, wherein a spacer is located in the at least one reinforcement opening and supports a longitudinal reinforcement within the at least one reinforcement opening in a position that prevents contact between the longitudinal reinforcement and an inner edge of the at least one reinforcement opening, wherein the spacer is formed of a plastic material and includes a substantially central support collar formed by opposed arcuate segments, and a top of the support collar is open.

18. The foundation unit of claim 17, wherein the spacer snap-fits into the at least one reinforcement opening.

19. A foundation unit for use in constructing a combination metal and cast-in-place concrete foundation structure, the foundation unit comprising:

a first elongated upright metal wall member and a second elongated upright metal wall member spaced apart from the first elongated upright wall member to define a channel therebetween, and multiple upright metal supports located within the channel, wherein the multiple upright metal supports extend laterally between the first elongated upright metal wall member and the second elongated upright metal wall member to (i) define multiple cells along a length of the channel and (ii) rigidly connect the first elongated upright metal wall member to the second elongated upright metal wall member, wherein each of the cells is open at the top, wherein at least one upright metal support includes at least one flow opening extending therethrough for permitting cast-in-place concrete to flow from a first one of the cells through the upright metal support to a second one of the cells during concrete pouring, wherein at least one of the upright metal supports includes at least one reinforcement opening, wherein a spacer is located in the at least one reinforcement opening and supports a longitudinal reinforcement within the at least one reinforcement opening in a position that prevents contact between the longitudinal reinforcement and an inner edge of the at least one reinforcement opening, wherein the spacer includes an inner support collar and a peripheral portion of the inner support collar is open.

20. The foundation unit of claim 19, wherein the spacer includes lead in guides that form an entry throat to the inner support collar.

21. The foundation unit of claim 19, wherein the spacer is formed of a plastic material and snap-fits into the at least one reinforcement opening.

* * * * *